US007211173B1

(12) United States Patent
Staerzl et al.

(10) Patent No.: US 7,211,173 B1
(45) Date of Patent: May 1, 2007

(54) SYSTEM FOR INHIBITING FOULING OF AN UNDERWATER SURFACE

(75) Inventors: Richard E. Staerzl, Fond du Lac, WI (US); Christopher J. Misorski, Fond du Lac, WI (US); Kevin R. Anderson, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 446 days.

(21) Appl. No.: 10/629,814

(22) Filed: Jul. 29, 2003

(51) Int. Cl.
*C23F 13/00* (2006.01)

(52) U.S. Cl. ..... 204/196.37; 204/196.18; 204/196.19

(58) Field of Classification Search ..... 204/196.21, 204/196.36, 196.37, 196.18, 196.19; 205/740
See application file for complete search history.

(56) References Cited

U.S. PATENT DOCUMENTS

| | | | | |
|---|---|---|---|---|
| 948,355 A | | 2/1910 | Tatro et al. | |
| 1,021,734 A | | 3/1912 | Delius et al. | |
| 3,069,336 A | | 12/1962 | Waite et al. | 204/148 |
| 3,241,512 A | | 3/1966 | Green | 114/222 |
| 3,497,434 A | | 2/1970 | Littauer | 204/147 |
| 3,625,852 A | | 12/1971 | Anderson | 204/196 |
| 3,661,742 A | | 5/1972 | Osborn et al. | 204/147 |
| 3,721,574 A | | 3/1973 | Schneider et al. | 106/74 |
| 3,766,032 A | | 10/1973 | Yeiser | 204/147 |
| 4,046,094 A | | 9/1977 | Preiser et al. | 114/222 |
| 4,058,075 A | | 11/1977 | Piper, Sr. | 114/222 |
| 4,092,943 A | | 6/1978 | Lund et al. | 114/222 |
| 4,162,169 A | | 7/1979 | Schutt | 106/74 |
| 4,170,185 A | | 10/1979 | Murphy et al. | 114/222 |
| 4,196,064 A | * | 4/1980 | Harms et al. | 205/735 |
| 4,283,461 A | | 8/1981 | Wooden et al. | 428/422 |
| 4,297,394 A | | 10/1981 | Wooden et al. | 427/100 |
| 4,322,633 A | | 3/1982 | Staerzl | 307/95 |
| 4,559,017 A | | 12/1985 | Cavil et al. | 440/76 |
| 4,869,016 A | | 9/1989 | Diprose et al. | 43/124 |
| 4,943,954 A | | 7/1990 | Ostlie | 367/191 |
| 5,052,962 A | | 10/1991 | Clark | 440/83 |

(Continued)

FOREIGN PATENT DOCUMENTS

| | | |
|---|---|---|
| WO | WO 98/18855 | 5/1998 |

OTHER PUBLICATIONS

Ship Fouling, Problems & Solutions, Maureen Callow, Chemistry & Industry, Section 5, p. 123, Mar. 5, 1990.

(Continued)

*Primary Examiner*—Bruce F. Bell
(74) *Attorney, Agent, or Firm*—William D. Lanyi

(57) ABSTRACT

A marine fouling inhibiting system comprises first and second conductors which are made of a polymer matrix, such as vinyl ester, and a suspended conductor, such as graphite powder or particles. This type of conductive material is formed to provide two sections of a boat hull so that a source of electrical current can be used to reversibly cause an electric current to flow to and from the conductive coatings. The conductive coatings are electrically insulated from each other in order to force the formation of an electrical circuit which includes the two conductive coatings, the source of electrical current, and the water in which the boat hull is disposed. This results in the creation of chlorine bubbles on the conductive surfaces. Chlorine bubbles on the boat hull surfaces discourage the formation of marine growth, such as barnacles.

5 Claims, 2 Drawing Sheets

U.S. PATENT DOCUMENTS

| | | | | |
|---|---|---|---|---|
| 5,088,432 | A | 2/1992 | Usami et al. | 114/67 |
| 5,143,011 | A | 9/1992 | Rabbette | 114/222 |
| 5,298,794 | A | 3/1994 | Kuragaki | 307/95 |
| 5,342,228 | A | 8/1994 | Magee et al. | 440/76 |
| 5,344,531 | A | 9/1994 | Saito et al. | 204/147 |
| 5,386,397 | A | 1/1995 | Urroz | 367/139 |
| 5,465,676 | A | 11/1995 | Falcaro | 114/222 |
| 5,532,980 | A | 7/1996 | Zarate et al. | 367/139 |
| 5,552,656 | A | 9/1996 | Taylor | 310/337 |
| 5,716,248 | A | 2/1998 | Nakamura | 440/76 |
| 5,735,226 | A | 4/1998 | McNeal | 114/222 |
| 5,820,737 | A | 10/1998 | Kohn | 204/196 |
| 5,889,209 | A | 3/1999 | Piedrahita et al. | 73/570 |
| 5,929,159 | A | 7/1999 | Schutt et al. | 524/544 |
| 6,161,989 | A | 12/2000 | Kotani et al. | 405/151 |
| 6,173,669 | B1 | 1/2001 | Staerzl | 114/222 |
| 6,187,447 | B1 | 2/2001 | Stein et al. | 428/447 |
| 6,209,472 | B1 * | 4/2001 | Staerzl | 114/222 |
| 6,251,308 | B1 | 6/2001 | Butler | 252/511 |
| 6,365,069 | B2 | 4/2002 | Butler et al. | 252/511 |
| 6,367,406 | B1 * | 4/2002 | Sahr et al. | 114/357 |
| 6,514,401 | B2 | 2/2003 | Chyou et al. | 205/739 |
| 6,547,952 | B1 * | 4/2003 | Staerzl | 205/724 |
| 2004/0231975 | A1 * | 11/2004 | Boyd et al. | 204/196.18 |

OTHER PUBLICATIONS

Tinker concocts a Barnacle Paint with McCormicks Peppers, David Harrison, Baltimore Business Journal, vol. 10, No. 47, Section 1, p. 3, Apr. 3, 1993.

Brochure about Pemtex, no month/year available.

* cited by examiner

SYSTEM FOR INHIBITING FOULING OF AN UNDERWATER SURFACE

BACKGROUND OF THE INVENTION

1. Field of the Invention

The present invention is generally related to an apparatus and method for inhibiting the fouling of an underwater surface and, more particularly, to a coating which comprises electrically conductive particles disposed within a supporting matrix material, such as a graphite material supported by a vinyl ester matrix, which is used as a surface that is exposed to water and provided with an electrical current through it that results in the formation of chlorine bubbles on the surface.

2. Description of the Prior Art

Throughout the following discussion of the prior art and the description of the present invention, the unwanted growth on a ship s hull or other underwater surface will be referred to as fouling. Although fouling is primarily a biological phenomenon, its implications relate to engineering. Due to an increase in the resistance to movement of the hull through water, fouling of the hulls of boats and ships results in a reduction in speed, an increase in the cost of fuel, and losses in both time and money in the application of remedial measures.

Underwater surfaces rapidly absorb organic material, referred to as conditioning films, which may influence the subsequent settlement of microorganisms. Bacteria and diatoms are soon present after immersion in water, resulting in a slime that covers the submerged surface. Following the establishment of the micro fouling slime layer, macro fouling rapidly develops. The macro fouling community is often described as either soft fouling or hard fouling. Soft fouling comprises algae and invertebrates such as soft corals, sponges, anemones, tunicates, and hydroids while hard fouling comprises invertebrates such as barnacles, mussels, and tubeworms.

Various toxic and non-toxic solutions have been attempted. Both ultrasonic (e.g. 14 kHz) and low frequency (e.g. 30 Hz) sound waves inhibit barnacle settlement and may have application to fouling control in certain circumstances. These and many other anti-fouling techniques are described in an article written by Maureen Callow in the publication titled Chemistry and Industry at Section 5, pg. 123, on Mar. 5, 1990.

As described in the Baltimore Business Journal, Vol. 10, No. 47, Section 1, pg. 3 on Apr. 23, 1993, McCormick & Company has discovered that its red pepper extracts are natural repellents of barnacles and zebra mussels. A coating of this type has been tested, and it has been determined that it repels both barnacles and zebra mussels which have become costly nuisances in the Great Lake Region by clogging intake pipes for power plants and water treatment plants. It is estimated that several billion dollars in damage will be caused by zebra mussels before the turn of the century.

U.S. Pat. No. 5,532,980, which issued to Zarate, et al on Jul. 2, 1996, discloses a vibrational anti-fouling system. The system produces vibrations in an underwater structure for the purpose of inhibiting the attachment of aquatic life forms to the structure. The system includes a controller which drives one or more transducers. The transducer comprises a housing, one end of which is closed by a resilient diaphragm. An electromagnet with soft magnetic core is contained in the housing spaced from the unsupported portion of the diaphragm. The unsupported portion of the diaphragm is mounted over an underwater structure. In operation, the electromagnet is excited with a current pulse, which deforms the diaphragm so that the housing moves towards the structure. As the current drops off, the diaphragm is restored to its original shape and the housing moves away from the structure imparting a vibrational force to the structure. The transducer includes an elastic membrane to compensate the changes in temperature and pressure commonly found when working underwater. The magnetic cores positioned in the transducers are saturated by current pulses generated by the controller to eliminate the effects of component variations and allow multiple units to be connected to the controller without changes in sound levels. The system is highly resistant to electrolytic corrosion since, most of the time, there is no voltage difference between the resonators, wires and ground.

U.S. Pat. No. 5,386,397, which issued to Urroz on Jan. 31, 1995, describes a method and apparatus for keeping a body surface, which is in contact with water, free of fouling. A sound wave is generated for keeping a surface free of scale, fouling and dirt by the adherence of organisms such as marine life, the surface being part of the body that is in contact with water. The method comprising of steps of generating and emitting from at least one location of the body, at least one high frequency sound wave train forming, adjacent to the body surface, a vibrating field encircling the body surface. The molecular energy of the water within the field is increased to generate a drastic drop in the density of the water as well as the density of the cells of the organisms entering the vibrating field. This alters the habitat of the organisms and discourages the organisms from adhering to the body surface.

U.S. Pat. No. 4,058,075, which issued to Piper on Nov. 15, 1977, discloses a marine life growth inhibitor device. The device is used for inhibiting marine life on the outer surface of submerged object such as boat. The device includes a controller connected to a source of electrical power and a plurality of speakers electrically connected to the controller and attached at pre-determined locations on the interior of the boat s hull, whereby vibrations may be transmitted through the hull. The controller may also include a transformer for reducing the voltage of the alternating current power source. Each of the plurality of speakers has a speaker diaphragm having first and second speaker diaphragm sides. Each of the speakers is mounted in a speaker housing secured to the hull of the boat for enabling transfer of acoustical energy from both the first and second side of the speaker diagram to the boat hull to inhibit the growth of marine life on the exterior surface of the boat hull. The speakers are selected to produce acoustical vibration in the audible range.

U.S. Pat. No. 5,143,011, which issued to Rabbette on Sep. 1, 1992, discloses a method and apparatus for inhibiting barnacle growth on boats. The system for inhibiting growth of barnacles and other marine life on the hull of a boat includes a plurality of transducers or vibrators mounted on the hull and alternately energized at a frequency of 25 Hertz through a power source preferably the boat battery, and a control system. The system has two selectable operating modes. One is continuous and the other is periodic. Also, when the voltage of the battery falls below a predetermined level, transducers are automatically de-energized to allow charging of the battery after which the transducers are energized.

U.S. Pat. No. 3,241,512, which issued to Green on Mar. 22, 1966, describes an anti-fouling, barnacles, algae, eliminator. The apparatus is intended for boats and, in particular, comprises a pair of copper bus bars or electrodes, or a pair of perforated tubes, or both the electrodes and perforated tubes positioned on opposite sides of the keel of a boat whereby copper ions, chlorine gas or bubbles, or combination of the ions and chlorine gas produced bubbles that float upward from the keel on both sides thereof following the contour lines of the boat hull cleaning the surface thereof and removing barnacles, algae, and other foreign and undesirable matter.

U.S. Pat. No. 3,625,852, which issued to Anderson on Dec. 7, 1971, describes a marine anti-fouling system. The system is intended for use with boat and ship hulls having a keel and sides diverging upwardly therefrom. The anti-fouling system comprises a pair of laterally spaced elongated anode electrode components each mounted externally on one side of the hull substantially adjacent the keel and lengthwise thereof. It also comprises an elongated cathode electrode component mounted externally on and lengthwise of the keel in spaced relationship between the anode electrode components. The system further comprises a source of electrical current and electrical circuit means therefor for energizing the anode electrode components with a positive potential and the cathode electrode components with a negative potential with the cathode electrode component being electrolytically common to the anode electrode components.

U.S. Pat. No. 5,465,676, which issued to Falcaro on Nov. 14, 1995, discloses a barnacle shield. A system for discouraging and inhibiting marine growth onto a boat s underwater hull surface comprises a plurality of sections of foam filled PVC pipe tied together to form a flotation frame, an envelope of flexible, polyethylene, bubble wrap material, of a size and shape to enclose the underwater part of a boat s hull, and affixed to and supported by the flotation frame, a sprinkler hose affixed to the flotation frame for injecting fresh water for washing the boat s underwater hull, and a plurality of drain/check valves mounted in the envelope for eliminating the wash down water in the envelope.

U.S. Pat. No. 4,170,185, which issued to Murphy et al on Oct. 9, 1979, describes a means for preventing marine fouling. The effective antifouling result with respect to marine creatures such as barnacles is achieved by energizing a piezofilm layer carried on the outside of a vessel to cause mechanical vibration of the layer.

U.S. Pat. No. 4,046,094, which issued to Preiser et al on Sep. 6, 1977, discloses an antifouling system for active ships which are at rest. A system for discouraging and inhibiting growth of the entire marine fouling community onto a ship hull while it is at rest in brackish or seawater is described. A pipe or pipes having nozzles distributed therealong, run the length of the keel. Fresh water is supplied to the pipe which flows out the nozzles and up along the hull to create and maintain a moving boundary layer of fresh water. Such movement also serves to inhibit fouling. An enclosure comprising segmented, over-lapping opaque curtains hang down by weights, from the ship-deck. These curtains serve to prevent light from reaching the hull, and to protect the thin boundary layer of fresh water from the disruptive, mixing actions caused by the surrounding currents. Thus the marine fouling community, including tubeworms, barnacles, grass, and algae, may be inhibited from growing and adhering to the hull surface.

U.S. Pat. No. 4,283,461, which issued to Wooden et al on Aug. 11, 1981, describes a piezoelectric polymer antifouling coating. An antifouling coating for marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage is disclosed.

U.S. Pat. No. 5,342,228, which issued to Magee et al on Aug. 30, 1994, discloses a marine drive which is provided with a large volume anode, about 30 cubic inches, for galvanic protection. The anode is a brick-like block member tapered along each of its height, width, and length dimensions. The drive housing has a anode mounting section extending rearwardly therefrom and has a downwardly opening cavity of substantially the same shape and volume as the anode, and receiving the anode in nested flush relation.

U.S. Pat. No. 5,716,248, which issued to Nakamura on Feb. 10, 1998, discloses a sacrificial anode for a marine propulsion unit. The sacrificial anode arrangements for a marine propulsion unit is disclosed wherein the sacrificial anode is juxtaposed to the trim tab and is detachably connected to the lower unit housing by fastening means which can be removed from the upper surface thereof. In one embodiment, the trim tab is detachably connected to the sacrificial anode and is connected to the outer housing portion through the sacrificial anode.

U.S. Pat. No. 5,298,794, which issued to Kuragaki on Mar. 29, 1994, describes an electrical anticorrosion device for a marine propulsion apparatus. The device primarily relates to an electrical anticorrosion apparatus for a marine propulsion arrangement. More particularly, the device relates to an anodic protection arrangement which is suitable for use with an inboard/outboard propulsion unit. According to the description in this patent, an anode and the reference electrode are housed within a housing unit which is mounted upon a propulsion unit mounting bracket. The two electrodes are arranged so that each is essentially equidistant from a point located approximate midway across the lateral width of an outboard drive unit, which unit is secured to the mounting bracket, when the unit is positioned for driving the associated watercraft in a generally forward direction.

U.S. Pat. No. 4,322,633, which issued to Staerzl on Mar. 30, 1982, discloses a marine cathodic protection system. The system maintains a submerged portion of the marine drive unit at a selected potential to reduce or eliminate corrosion thereto. An anode is energized to maintain the drive unit at a pre-selected constant potential in response to the sensed potential at a closely located reference electrode during operation. Excessive current to the anode is sensed to provide a maximum current limitation. An integrated circuit employs a highly regulated voltage source to establish precise control of the anode energization.

U.S. Pat. No. 5,052,962, which issued to Clark on Oct. 1, 1991, describes a naval electrochemical corrosion reducing. The corrosion reducer is used with ships having a hull, a propeller mounted on a propeller shaft and extending through the hull, therein supporting the shaft, at least one thrust bearing and one seal. Improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and the power output circuit receiving signals from the differential amplifier and being supplied by at least one current supply. The current selector includes a brush assembly in contact with a slip ring over the shaft so that its potential may be applied to the differential amplifier.

U.S. Pat. No. 4,559,017, which issued to Cavil et al on Dec. 17, 1985, discloses a constant voltage anode system. The marine propulsion unit has a housing exposed to sea water and subject to attack by the sea water. It has a permanent type anode housing with a substantially constant surface characteristic which is mounted on the housing and supplied with constant voltage. Holes under the anode through the housing which extend to interior passages permits the current of the anode to influence and protect the passages.

U.S. Pat. No. 3,497,434, which issued to Littauer on Feb. 24, 1970, discloses a method for preventing fouling of metal in a marine environment. It anodically dissolves metals that are toxic to marine organisms. This is done under controlled conditions to prevent fouling by marine organisms of structures immersed in a marine environment.

U.S. Pat. No. 5,889,209, which issued to Piedrahita et al on Mar. 30, 1999, describes a method and apparatus for preventing biofouling of aquatic sensors. A submersible ultrasonic emitter is integrated with a dissolved oxygen or other aquatic probe so that biofouling of the sensors membrane is minimized. Sonification, that is, exposure to ultrasound, precludes the needs to use other biofouling elimination procedures such as water/air jets, chemical treatments, or biocides. The invention can be configured to readily integrate with existing probes from a variety of manufacturers, and eliminates membrane cleaning as the maintenance interval constraint for field or laboratory deployed sensors.

U.S. Pat. No. 5,735,226, which issued to McNeal on Apr. 7, 1998, describes a marine anti-fouling system and method. The system and method is disclosed for inhibiting the growth of marine life on a submerged surface and includes a control box and a number of transducers. The control box further includes an ultrasonic driver board, a magna-polar filter, and a power source. The ultrasonic driver board generates an electrical signal having an ultrasonic frequency which continually varies between 25 KHz and 60 KHz. A portion of this continually varying electrical signal is passed through the magna-polar filter where the signal is enhanced. This enhanced signal is then returned to the ultrasonic driver board where is combined with the electrical signal varying between 25 KHz and 60 KHz. This combined signal is then electrically communicated to a number of transducers which are mounted on the submerged surface to be protected. There, the electrical signal having combined frequencies is translated from electrical energy to acoustic energy which is transmitted to the submerged surface to inhibit the growth of marine life on the submerged surface.

U.S. Pat. No. 5,552,656, which issued to Taylor on Sep. 3, 1996, describes a self-powered anti-fouling device for watercraft. The device comprises a layer of piezoelectric material, preferably a poled plastic material such as a PVDF polymer, for mounting on the hull of a watercraft. The layer has electrodes on opposite major surfaces thereof, and the layers are connected to a power supply comprising a battery and a d.c to a.c. converter. The converter generates an a.c. voltage at a frequency, such as 20 KHz, for causing vibrations of the layer, such vibrations serving to retard the growth of water dwelling organisms in the craft. The layer electrodes are also connected to an a.c. to d.c. converter for converting a.c. energy to d.c. energy suitable for trickle charging the power supply battery. Accordingly, during transit of the craft through the water, water induced hull vibrations cause vibrations of the layer for generating a.c. energy for storage in the battery, which stored energy is used for causing anti-fouling vibrations of the energy generating layer.

U.S. Pat. No. 4,943,954, which issued to Ostlie on Jul. 24, 1990, describes a method and system for counteracting marine biologic fouling of a hull or submerged construction. A system and a method for counteracting marine fouling of a vessel hull are provided. Electro-mechanical vibration transducers are arranged in pairs adjacent to fixed nodal lines on the hull and are driven in an inverted phase relationship in order to provide a water particle movement in a hull parallel direction right outside side nodal lines in addition to the hull perpendicular relative movements right outside the transducers. The invention also comprises a combination of the mechanical system above and a special surface coating which counteracts fouling from other organisms than those influenced by the water particle movement in the infrafrequency range.

U.S. Pat. No. 4,058,075, which issued to Piper on Nov. 15, 1977, describes a marine life growth inhibitor device. The device is used for inhibiting marine life on the outer surface of a submerged object such as a boat. The device includes a controller connected to a source of electrical power and a plurality of speakers electrically connected to the controller and attached at predetermined locations on the interior on the boat s hull, whereby vibrations maybe transmitted through the hull. The controller may also include a transformer for reducing the voltage of the alternating current power source. Each of the plurality of speakers has a speaker diaphragm having a first and a second speaker diaphragm side. Each of the speakers is mounted in a speaker housing secured to the hull of the boat for enabling transfer of acoustical energy from both the first and second side of the speaker diaphragm to the boat hull to inhibit the growth of marine life on the exterior surface of the boat hull. The speakers are selected to produce acoustical vibration in the audible range.

U.S. Pat. No. 4,092,943, which issued Lund et al on Jun. 6, 1978, describes a marine protection system. An underwater marine protection system for preventing or retarding marine growth on vessels, pilings, in submerged structures in which a boat slip, or the like, has a series of gas diffusers placed under the water located to direct gas towards the bottom of the marine vessel is described. The gas diffusers are connected to an ozone source for direction ozone gas through the diffusers towards the bottom of a boat. Skirts or curtains are connected to the pilings in the boat slip to prevent the free flow of water into and out of the slip where the water has been treated. A special top extends across the slip and around the vessel therein to increase the effectiveness of the ozone. An alternate embodiment has the gas diffusers formed in the bottom of the boat or submarine structure.

U.S. Pat. No. 4,170,185, which issued to Murphy et al on Oct. 9, 1979, discloses a system for preventing marine fouling. The effective antifouling result with respect to marine creatures such as barnacles is achieved by energizing a piezofilm layer carried on the outside of a vessel to cause mechanical vibrations of the layer.

U.S. Pat. No. 3,069,336, which issued to Waite et al on Dec. 18, 1962, discloses a means for protecting ships hulls. The system relates to ships and in particular to the protection of metal hulls against corrosion, but it further relates to the protection of ships hulls against fouling with barnacles or other similar marine growth and marine vegetation.

U.S. Pat. No. 3,766,032, which issued to Yelser on Oct. 16, 1973, discloses a method for controlling marine fouling. An electrical apparatus and method is disclosed for eliminating the fouling of boat bottoms and the like by marine growth. The underwater surface is sheathed with strips of metal such as stainless steel. An electric current is passed between the adjacent strips or areas, preferably for short periods of time on a regular maintenance schedule (e.g. 30 amperes per square foot for a few seconds every two days). The sheathing may be of 0.020 stainless steel in 3-inch wide strips spaced 0.100 inches apart. Test panels in sea water are found to remain clean and bright after six months immersion when so energized, while identical panels to which no current is applied become heavily fouled. Ions produced by electrolysis close to the sheathed surface move at relatively high velocities, and are found to kill the small organisms that settle on the surface. No persistent toxic chemicals such as mercury compounds are released into the water, and only minute quantities of dead organic matter are released at any time.

U.S. Pat. No. 3,661,742, which issued to Osborn et al on May 9, 1972, describes an electrolytic method of marine fouling control. The improved method of inhibiting the sustained attachment of marine organisms to metallic surfaces while preventing corrosion of the metallic surfaces by cathodic protection is disclosed. Inhibition of marine organisms attachment takes place when toxic ions are forced into solution by reversing and increasing the current density in the cathodic protection system at periodic intervals for short periods of time.

U.S. Pat. No. 1,021,734, which issued to Delius et al on Mar. 26, 1912, describes a process for protecting ships from barnacles. The invention relates to sea going vessels which have hulls which are either made of metal or sheathed with metal and is intended for protection of vessels from the accumulation of barnacles. This is accomplished by providing a means for electrically destroying the barnacles that may be attached to the ship.

U.S. Pat. No. 4,869,016, which issued to Diprose et al on Sep. 26, 1989, describes a marine biofouling reduction invention. The method provides a substantial reduction of marine corrosion in sea water by micro and macro biofouling. An alternating current is generated of sufficient strength and frequency sufficient to shock marine biofouling organisms and sufficient to upset the normal behavior patterns of the marine biofouling organisms and trained in the sea water passing around or through the structure. The device causes release into the water around or within the structure controlled amounts of chlorine ions and copper ions to produce an environment actively hostile to potential marine biofouling organisms.

U.S. Pat. No. 5,088,432, which issued to Usami et al on Feb. 18, 1992, describes a system for providing anti-fouling for substances in contact with sea water. It comprises a first conductive membrane that is coated on the outer side of the electric insulator mounted at the surface of the substance such as ships and composes thin sheets of metal having low specific resistance or metal oxide, spray-coated membrane, evaporated membrane, or fused membrane. The second conductive anti-fouling membrane has a higher electric resistance than the first conductive membrane.

U.S. Pat. No. 5,820,737, which issued to Kohn on Oct. 13, 1998, describes an anti-fouling laminate marine structure. The structure is submersible in sea water, such as a boat hull, and is electrically activated. The hull is formed of inner and outer skins. The outer skin forms an exposed surface and is coated with a metallic paint defining a cathode electrode. The core is constituted by balsa wood or foam plastic modules. This is attached to an open mesh material that includes conductive fibers to create an electrical grid defining anodic electrode that is embedded in the laminate.

U.S. Pat. No. 6,209,472, which issued to Staerzl on Apr. 3, 2001, discloses an apparatus and method for inhibiting fouling of an underwater surface. The system for inhibiting marine organism growth on underwater surfaces provides an electric current generator which causes an electric current to flow proximate the underwater surface. A power source, such as a battery, provides electrical power to the electric current generator. The flow of current passes from the underwater surface through the water surrounding the surface or in contact with the surface and a point of ground potential. The point of ground potential can be a marine propulsion system attached to a boat on which the underwater surface is contained.

U.S. Pat. No. 948,355, which issued to Tatro et al on Feb. 8, 1910, describes an expeditious and inexpensive means for removing pests from ship s bottoms and for protecting from such pests any non-metallic objects located or moving under seawater. The system uses the anode and the cathode of an electric battery and the two poles of the battery must both be in contact with the seawater so that the circuit of the electric current must be completed through the water.

U.S. Pat. No. 6,173,669, which issued to Staerzl on Jan. 16, 2001, discloses an apparatus and method for inhibiting fouling of an underwater surface.

The marine fouling prevention system comprises two conductive surfaces and a device that alternates the direction of the electric current between the two surfaces. The current is caused to flow through seawater in which the two surfaces are submerged or partially submerged. A monitor measures the current flowing from one of the two conduction surfaces and compares it to the current flowing into the other conduction surface to assure that no leakage of current of substantial quantity exists. The system applies a low magnitude current density, of approximately 0.10 to 0.50 milliamperes per square foot, for an extended duration of time of approximately 10 to 20 minutes. By alternating current direction between the two surfaces, both surfaces can be provided with sufficient chlorine bubbles to prevent marine growth from attaching to the surfaces.

U.S. Pat. No. 5,929,159, which issued to Schutt et al on Jul. 27, 1999, describes an oligomeric silicon coating composition, articles coated therewith and method for forming coating composition and coated articles based thereon. Corrosion resistant coatings are provided by aqueous-alcoholic acidic dispersions of the partial condensate of monomethyl silanol (by hydrolysis of monomethyl alkoxysilane) alone or in admixture with minor amounts of other silanol, e.g. gamma-glycidyloxy silanol, phenyl silanol, etc., wherein the dispersions contain divalent metal cations, e.g., $Ca^{+2}$, in place of all or most of colloidal silica used in prior formulations of this type. The coatings may be applied to boat hulls, including aluminum hulls and are effective in preventing corrosion from salt water for extended periods.

U.S. Pat. No. 3,721,574, which issued to Schneider et al on Mar. 20, 1973, describes silicate coatings compositions. Water resistant and air drying alkali metal silicate coatings contain a base of an alkali metal silicate solution having a high molar ratio of solvated silica to alkali metal oxide. To this base is added colloidal silica in amounts to increase the $SiO_2$:alkali metal oxide mole ratio to as high as 9:1. The compositions are advantageously modified with silane wetting agents and multivalent metal ions, e.g., calcium. Ultimately, the coatings may be modified with various materials such as tetrafloroethylene polymer or zinc.

U.S. Pat. No. 4,162,169, which issued to Schutt on Jul. 24, 1979 describes an alkali-metal silicate binder and methods of manufacture. A paint binder utilizing a potassium or sodium silicate dispersion having a silicon dioxide to alkali-metal oxide mol ratio of from 4.8:1 to 6.0:1, in which the binder exhibits stability during both manufacture and storage is disclosed. The process of making the binder is predictable and repeatable and the binder may be made with inexpensive components. The high mol ratio is achieved with the inclusion of a silicon dioxide hydrogel. The binder, which also employs a silicone, is in the final form of a hydrogel sol.

U.S. Pat. No. 6,187,447, which issued to Stein et al on Feb. 13, 2001, describes a condensation curable silicone foul release coatings and articles coated therewith. Anti-fouling coatings comprise a room temperature vulcanizable polyorganosiloxane composition and a polyorganosiloxane free from silanol groups and comprising at least one hydroxy- or alkoxy-terminated polyoxyalkylenealkyl radical. The latter is capable of blooming to the surface of the cured room temperature vulcanizable composition, thus inhibiting the deposition of marine life on the coated article.

U.S. Pat. No. 6,161,989, which issued to Kotani et al on Dec. 19, 2000, describes an antifouling wall structure for use in pipe and method of constructing the antifouling wall therefor. A wall surface of a structure to be rendered antifouling is covered with antifouling panels caused to firmly adhere thereto and fixed. Not only can this work be conducted easily and quickly but also part of the antifouling panels can be easily replaced. The disclosed antifouling wall structure and the method of constructing the antifouling wall are characterized in that antifouling panels each comprising a base material layer and, formed thereon, an antifouling paint layer are arranged on a wall surface of structure to be rendered antifouling so that the antifouling panels have their side of antifouling paint layer brought into contact with water and detachably fixed by means of fastening members.

U.S. Pat. No. 5,344,531, which issued to Saito et al on Sep. 6, 1994, describes a prevention method of aquatic attaching fouling organisms and its apparatus. The invention relates to a method of preventing or controlling aquatic attaching fouling organisms which comprises covering aquatic organisms attaching portions on the surfaces of submerged structures or intake facilities with a plurality of mutually insulated metallic covers made of iron, magnesium, aluminum or their alloys through an insulating material and a cushion; using each of the metallic covers as an electrode; forming an electric circuit using the metallic covers facing each as a pair, connecting the electrode to a D.C. power supply having a polarity reversal function so as to supply a current between both poles either continuously or intermittently, and reversing the polarity of the current so that when one of the metallic covers is an anode, the surface of the metal constituting the metallic cover is dissolved and activated, and attachment of the aquatic fouling organisms to the surfaces of the metallic covers is prevented or controlled.

World Intellectual Property Organization patent application WO 98/18855, which was filed by Gedeon et al on Oct. 23, 1999 and assigned the International Application number PCT/US97/18964, describes a silicon coating composition. Corrosion resistant coatings are provided by Aqueous-alcoholic acidic dispersions of the partial condensate of monomethyl silanol (by hydrolysis of monomethyl alkoxysilane) alone or in mixture with minor amounts of other silanol (e.g., gamma-glycidyloxy silanol, phenyl silanol, etc.) wherein the dispersions contain divalent metal cations (e.g., $Ca^{+2}$) in place of all or most of colloidal silica used in prior formulations of this type. The coatings may be applied to boat hull, including aluminum hulls and are effective in preventing corrosion from salt water for extended periods.

U.S. Pat. No. 4,196,064, which issued to Harms et al on Apr. 1, 1980, describes a marine fouling control apparatus. A structure exposed to a marine environment is coated with a coating comprising stainless steel particles such as stainless steel flakes in a coating matrix. Marine growth is removed from the coating by impressing an electrical potential. Marine growth is also prevented. Preferably, the structure is coated with a first coating comprising metallic zinc prior to coating with a second coating comprising stainless steel flakes in an inorganic polymer matrix, and a cathodic potential is impressed.

U.S. Pat. No. 4,297,394, which issued to Wooden et al on Oct. 27, 1981, describes a piezoelectric polymer antifouling coating and method of use and application. An antifouling coating with method of use and method of application on marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage.

U.S. Pat. No. 6,547,952, which issued to Staerzl on Apr. 15, 2003, discloses a system for inhibiting fouling of an underwater surface. An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint. In this way, boat hulls, submerged portions of outboard motors, and submerged portions of stern drive systems can be protected effectively from the growth of marine organisms, such as barnacles. The electrically conductive surface generates electrons into the seawater in order to create chlorine gas at the surface which inhibits and discourages marine growth. The protective coating of glass inhibits the migration of metal ions from the electrically conductive surface into the seawater and therefore inhibits corrosive degradation as a result of galvanic action.

U.S. Pat. No. 6,251,308, which issued to Butler on Jun. 26, 2001, describes a highly conductive molding compound and fuel cell bipolar plate comprising the highly conductive molding compounds. A conductive polymer is disclosed which is suitable for use in applications which require corrosion resistance including resistance to corrosion when subjected to acidic flow at temperatures ranging from 40 to 140 degrees Fahrenheit and which can be molded into highly intricate and thin specimens which exhibit consistent conductivity, sufficient strength and flexibility, and appropriate surface characteristics. In particular the invention involves molding unsaturated prepolymer resin composition which have high loadings of conductive fillers. Further to enable the necessary characteristics, the compositions include rheological modifiers such as Group II oxides and hydroxides; carbodiamides; aziridines; polyisocyanates; polytetrafluoroethylene (PTFE) perfluoropolyether (PFPE), and polyethylene. Ostensibly, these modifiers act to alter the apparent molecular weight and three dimensional prepolymer network structures correcting rheological deficiencies which otherwise lead to excessive resin particulate separation during the molding process and large variances in bulk conductivity across the plate surface. The composition is disclosed for use in electrochemical cells, such as fuel cells.

U.S. Pat. No. 6,365,069, which issued to Butler et al on Apr. 2, 2002, describes a process of injection molding highly conductive molding compounds and an apparatus for this process. A technique and apparatus are disclosed for injection molding highly filled conductive resin compositions. These compositions include one or more of saturated polyester and vinyl ester resin, a copolymer having a terminal ethylene group, and at least about 50 weight percent of an inorganic particulate conductive filler, an initiator, and a rheological modifier to prevent phase separation between the resin and the conductive filler during molding. The method of the invention allows these compositions to be molded into highly intricate and thin electrically and thermally conductive specimens without significant post process machining. The method involves the use of an injection molding apparatus that has a hopper with an auger having a vertical component in its positioning to feed into the feed throat of an injection molding machine which has a phenolic screw that has been modified to have a constant inner diameter and a constant flight depth.

The patents described above are hereby explicitly incorporated by reference in the following description.

As described above, fouling of underwater surfaces has been recognized as a problem for many years. Anti-fouling techniques, such as biocidal paints, can contribute to the pollution of waterways. Many other methods simply are not effective. It would therefore be significantly beneficial if a device or method could be developed which does not pollute the environment, but which effectively inhibits the growth of marine organisms on surfaces which are submerged in water such as boat hulls, pipes, pilings, and grates.

The Staerzl patents describe above (i.e. U.S. Pat. Nos. 6,173,669 and 6,209,472 and 6,547,952) are generally related to systems and apparatus which cause an electric current to flow between submerged conductive materials and other electrodes in such a way that gaseous chlorine is formed on the surface of the material when the electrically conductive material is connected as an anode to a source of power, such as a current source. It has been determined that the production of chlorine gas in this way is effective in inhibiting the growth of organic material, such as barnacles, on the surface. The Butler patents described above (U.S. Pat. Nos. 6,251,308 and 6,365,069) relate to a highly conductive plastic material that can be molded and shaped to form many different types of structures. This type of material has been used in fuel cells because of its high electrical conductivity and its resistance to attack by chemicals.

The conductive material used to create the gaseous chlorine on its surface can be virtually any conductive material. However, the properties of certain conductive materials significantly affect the applicability of those materials for these purposes. For example, the use of an active metal as an anode can result in a degradation of the metallic electrode because metallic ions are typically emitted from the conductive materials into the surrounding seawater. This is a natural result caused by the use of the active metal as an anode in the circuit. Other materials, such as graphite, have a significantly reduced tendency to give off ions into the seawater and, therefore, are essentially not eroded in this way. However, materials such as graphite often exhibit a higher resistance to electric current flow because of the manner in which the coating is typically formulated. Other materials, such as silver, gold, and platinum, could serve as effective electrodes for the purpose of producing gaseous chlorine, but these materials are expensive and therefore could not be used in large quantities without being cost prohibitive.

In recent years, certain compounds have been developed which incorporate 70 90 percent graphite powder, by weight, in a vinyl ester matrix or other polymer based matrices. Some of these compounds have the stiffness, toughness, tensile strength, chemical resistance, compressive creep resistance, and heat resistance to survive 80 degrees Centigrade temperatures and acidity that is inherent in certain fuel cell environments. These materials exhibit high electrical conductivity because of the homogenous distribution of graphite within the vinyl ester matrix. The compounds used to produce these conductive plates are also highly resistive to chemicals.

Quantum, a subsidiary of Premix Inc., provides a product called Pemtex in commercial quantities. Pemtex is a conductive and corrosion resistant composite material. This material can be used in fuel cell processors.

It would therefore be significantly beneficial if an electrically conductive coating could be used for these purposes of inhibiting marine fouling in which a conductive material can be provided within a supportive matrix to act as the electrode. It would also be significantly beneficial if the electrically conductive coating could be applied as a retrofit to existing objects which are intended to be at least partially submerged.

SUMMARY OF THE INVENTION

An apparatus for inhibiting the fouling of a submersible object, made in accordance with a preferred embodiment of the present invention, comprises a first coating disposed on a first surface of an object which is submersible. The first coating comprises a matrix material having conductive particles disposed therein. The present invention further comprises an electrical current source which is connectable in electrical communication with the first coating and with an electrode which is connectable in electrical communication with the electric current source to form an electrical circuit comprising the first coating, the electric current source, the electrode, and the water in which both the electrode and first coating are disposed.

The electrode, in certain embodiments, comprises a second coating which, in turn, comprises the matrix material having the conductive particles disposed therein. In certain applications of the present invention, the first and second coatings are attached to port and starboard portions of a boat hull. The matrix material can be vinyl ester and the conductive particles can be graphite.

Electric current flowing through the electrical circuit is periodically reversed, with the first coating alternatively acting as an anode and a cathode of the electrical circuit. When the present invention is used in conjunction with a boat hull in which it comprises first and second coatings, the electric current flowing through the electrical circuit, which also comprises the water in which both the first and second coatings are disposed, is periodically reversed. The first and second coatings alternately act as anodes and cathodes because of the reversal of current, with each of the first and second coatings acting as an anode when the other is acting as a cathode and vice versa.

Although a preferred embodiment of the present invention uses a matrix material which is vinyl ester and the conductive particles are graphite, alternate combinations of different materials are also within its scope.

The present invention can be used in conjunction with a boat hull which comprises a fiberglass layer, a conductive layer, and an intermediate layer. The conductive layer comprises the first and second coatings. The boat hull has a starboard side and a port side. The port side of the hull is at least partially covered by the first coating and the starboard side of the hull is at least partially covered by the second coating. The first and second coatings are electrically insulated from each other.

The boat hull has a structural supporting layer, which can be fiberglass. A first coating layer is disposed on the port side of the structural supporting layer and comprises the first material which is a vinyl ester and a second material, such as a graphite powder, suspended within the first material. Similarly, a second coating layer is disposed on a starboard side of the structural supporting layer in a similar manner. A source of current is connected in electrical communication with both the first and second coating layers in order to sequentially cause an electrical current to flow in a direction from the source of current toward the first coating layer and, subsequently, to cause the electrical current to flow in a direction from the source of current toward the second coating layer. An intermediate layer is disposed on the structural support layer with the first and second coating layers being disposed on the intermediate layer. The intermediate layer can be a gelcoat compound. The first and second coating layers, which are conductive, can be disposed on the outer surface of the intermediate gelcoat compound coating. In manufacturing a boat hull made according to the present invention, the hull is constructed by disposing the first and second coating layers in a mold, disposing the intermediate gelcoat layer over the first and second coating layers, and subsequently disposing the structural support layer over the intermediate layer. In certain applications, the first and second coating layers can be applied in a fluid form and then subsequently covered by the intermediate gelcoat layer.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
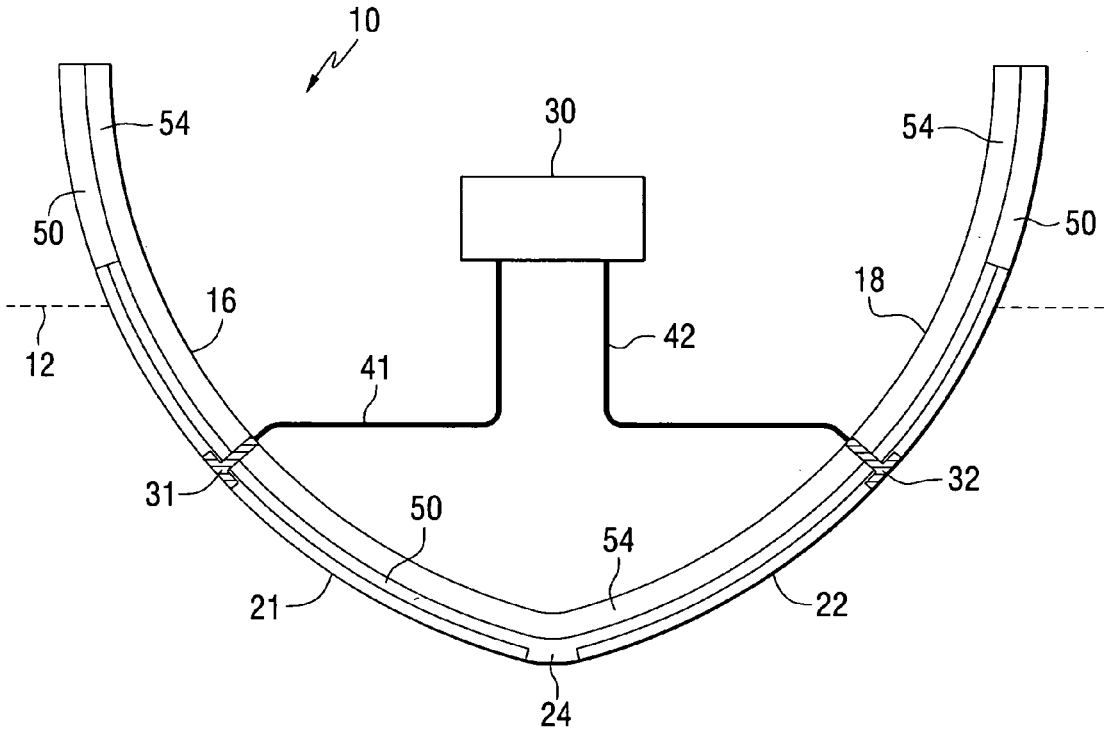
FIG. 1 is a section view of a boat hull made in accordance with the present invention.

Throughout the description of the preferred embodiment of the present invention, like components will be identified by like reference numerals.

FIG. 1 shows a boat hull 10 made in accordance with the preferred embodiment of the present invention. For purposes of reference, dashed line 12 represents an approximate location of a surface of water in which the boat hull 10 can be operated. The boat hull 10 is shown, in section view, having a port side 16 and a starboard side 18. A first coating 21 is disposed on a first surface of an object (e.g. the hull) which is submersible. The first coating 21 comprises a matrix material of vinyl ester which has conductive particles, such as graphite powder, disposed within the matrix. A second coating 22 is disposed on a starboard surface of the hull 10. The first and seconds coatings, 21 and 22, are disposed in such a way that direct electrical contact between the first and second coatings is prevented. In FIG. 1, the first and second coatings, 21 and 22, are separated from each other by a space identified by reference numeral 24. An electrical current source 30 is connectable in electrical communication with the first and second coatings, 21 and 22. The first and second coatings, 21 and 22, are connectable in electrical communication with the electric current source 30 to form an electrical circuit which comprises the first coating 21, the second coating 22, the electrical current source 30, and the water (i.e. below dashed line 12) in which both the first and second coatings are disposed, below the water line 12. When the boat hull 10 is disposed in seawater, the flow of current through this circuit causes the formation of chlorine bubbles on the wetted conductive surface that is current acting as an anode. This phenomenon is described in the prior art patents described above and particularly in the Staerzl patents. The creation of chlorine bubbles on the surfaces of the hull discourages marine growth.

With continued reference to FIG. 1, it should be understood that the electrical current flowing through the circuit described above is periodically reversed in the manner that is described in detail in the U.S. Pat. No. 6,547,952 and 6,209,472, described above. In addition, the periodic reversing of the electric current to create chorine bubbles on both the first and second coatings, 21 and 22, and thereby inhibit marine fouling of the boat hull 10 is also described in detail in U.S. Pat. No. 6,173,669. The electric current reversing technique will therefore not be described in significant detail herein.

With continued reference to FIG. 1, it can be seen that a port electrode 31 is connected in electrical communication with the first coating 21 and a starboard electrode 32 is connected in electrical communication with the second coating 22. Wires 41 and 42 are used for the purpose of connecting the port and starboard conductors, 31 and 32, to the electric current source 30. An intermediate layer 50, which can be made of gelcoat, is provided for the purpose of creating an aesthetically attractive outer surface for portions of the hull 10. Gelcoat is a well known compound that is used for many purposes which include the manufacturer of boat hulls and other surfaces which are exposed to water. In addition, a fiberglass layer 54, or structural supporting layer, is disposed inwardly from the intermediate layer 50.

Although many different techniques can be employed to manufacture a boat hull in accordance with the present invention, one particular method will be described below in conjunction with FIGS. 2–4.

Figure 2:
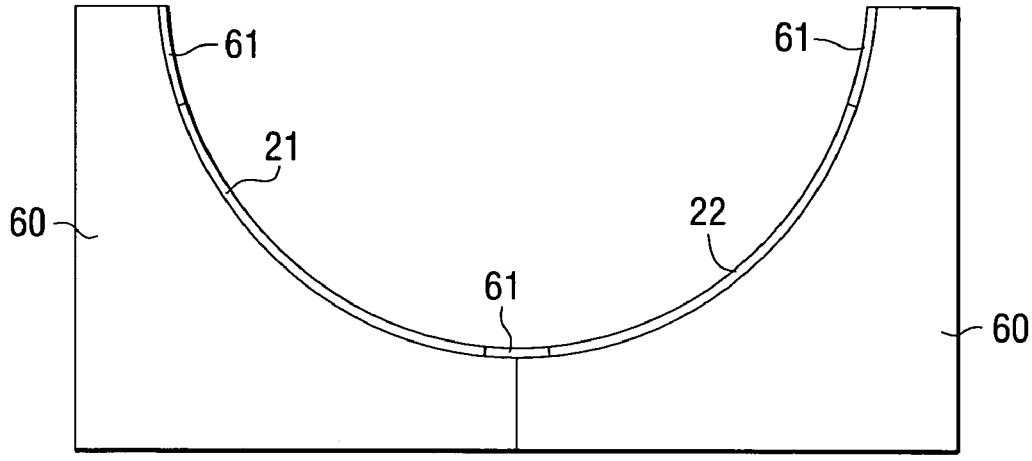
FIGS. 2, 3, and 4 show sequential steps in the manufacturing of a boat hull in accordance with the preferred embodiment of the present invention.

In FIG. 2, a reusable mold 60 is used to define the desired shape of the hull. In FIG. 2, the mold 60 is formed in two parts, but this is not a requirement in other embodiments of the present invention. A first step is to provide a masking component 61 at preselected locations on the inner surface of the mold 60. The masking component comprise sheets of masking material or any other applicable material. After the masking component 61 is in place as shown in FIG. 2, the material of the first and second coatings, 21 and 22, is applied to the mold 60. It adheres to the mold 60 at the locations which are not masked. When the masking material 61 is removed, the first and second coatings, 21 and 22, remain in the mold 60 at the location shown in FIG. 2, but not at the locations previously occupied by the masking material 61. At the keel, the first and second coatings are not in electrical contact with each other.

Figure 3:
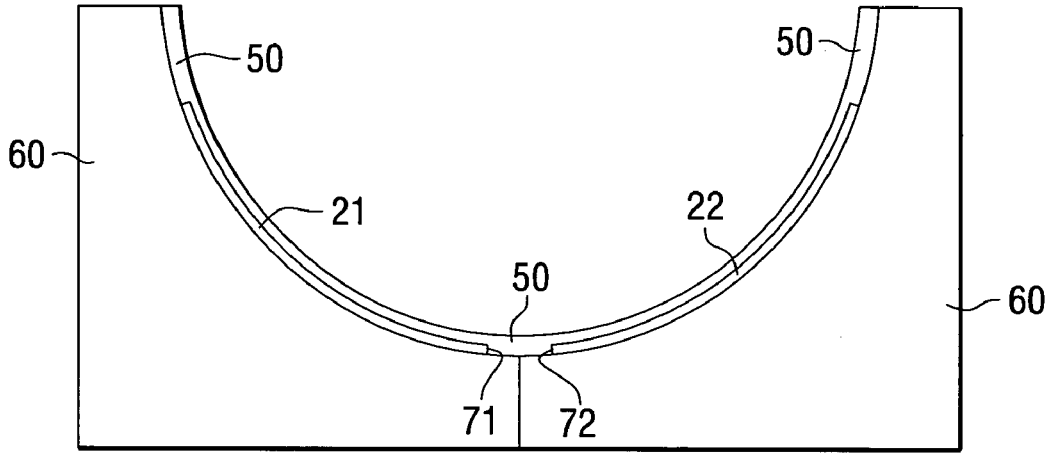

FIG. 3 shows the results of applying the intermediate layer 50, such as gelcoat, over the first and second coatings, 21 and 22, after the masking material 61 is removed. It can be seen that the gelcoat material or intermediate layer 50, is disposed between the proximate edges, 71 and 72, of the first and second coatings, 21 and 22. This is in the location previously identified by reference numeral 24 in FIG. 1 and separates the first and second coatings, 21 and 22, from electrical contact with each other.

Figure 4:
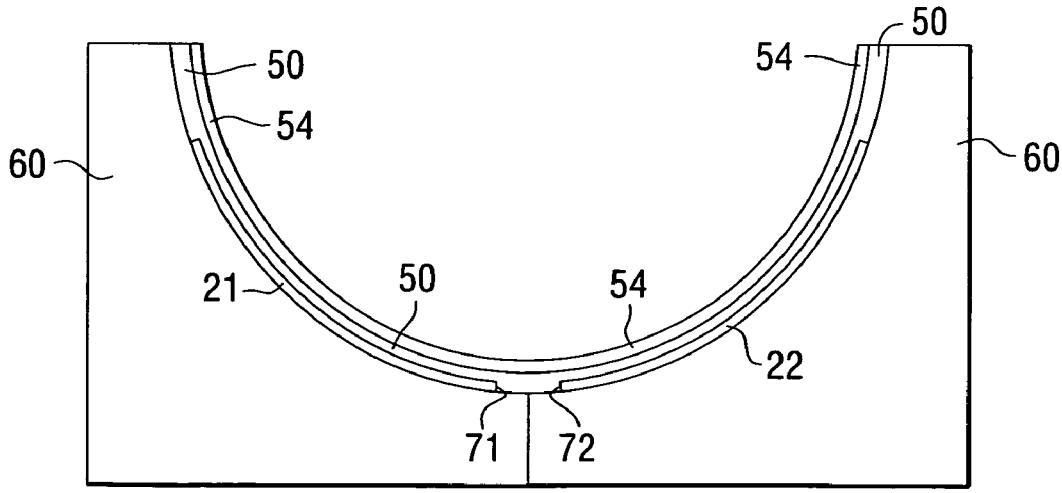

After the application of the intermediate layer 50, such as gelcoat, is completed, a structural supporting layer 54 is applied as shown in FIG. 4. The structural supporting layer can be a fiberglass layer which provides most of the structural support that retains the shape the hull 10 subsequent to the completion of the manufacturing process.

In conjunction with FIGS. 2 4, the installation of the port and starboard conductors, 31 and 32, is not shown. However, it should be understood that some type of connection to the first and second coatings, 21 and 22, is provided so that the electrical current source 30 can be connected to them for the purposes described in U.S. Pat. Nos. 6,547,952 and 6,173,669. U.S. Pat. No. 6,209,472 also discusses this concept.

The procedures described above in conjunction with FIGS. 2 4 show the manner that a new boat hull is constructed in accordance with the preferred embodiment of the present invention. However, it should be clearly understood that the conductive coatings, 21 and 22, can be applied to an existing boat hull after the structural layer and intermediate layer, or gelcoat layer, have been completed. This is particularly useful in the retrofitting of older boat hulls to incorporate the present invention over an existing boat hull or marine drive unit. In addition, it should be understood that, although the procedure above has been described in significant detail in relation to a boat hull, the present invention can be applied to a marine drive unit by applying the conductive coating to the outer surface of the drive unit and providing an electrode at a different location for the purpose of creating the circuit described above. This application of the present invention to a stern drive unit or other marine drive system would result in the creation of chlorine bubbles on the surface of the conductive material, such as the vinyl ester with embedded graphite particles, and discourage the growth of marine organisms on the surface of the drive unit.

With reference to FIGS. 1 4, it can be seen that when the hull 10 is removed from the mold 60 after completion of the step illustrated in FIG. 4, the resulting structure is the completed hull shown in FIG. 1. The apparatus for inhibiting the fouling of the submersible object by marine organisms, made in accordance with the preferred embodiment of the present invention, comprises a boat hull 10 having a port side 16 and a starboard side 18. The boat hull 10 comprises a structural supporting layer 54. A first coating layer 21 is disposed on the port side 16 of the structural supporting layer 54 and comprises a first material having a second material suspended within the first material. In a preferred embodiment of the present invention, the first material is a vinyl ester matrix and the second material is a graphite powder. This particular type of material is available in commercial quantities from Quantum, a division of Premix Incorporated, and is identified by the name Pemtex. A second layer 22 is disposed on the starboard side 18 of the structural supporting layer 54 and comprises the same compound which, in turn, comprises the first material which acts as a matrix to support the second material which is electrically conductive. A source of current 30 is connected in electrical communication with the first and second coating layers, 21 and 22, to sequentially cause an electrical current to flow in a direction from the source of current 30 toward the first coating layer 21 and subsequently to cause the electrical current to flow in a direction from the source of current 30 to the second coating layer 22. An intermediate layer 50 is disposed on the structural support layer 54, with the first and second coating layers, 21 and 22, being disposed on the intermediate layer 50. The intermediate layer can be a gelcoat compound in a preferred embodiment of the present invention. The first and second coating layers comprise graphite particles supported in a vinyl ester matrix in a preferred embodiment. By alternating current in the manner described above and in the manner described in the prior art patents discussed above, chlorine bubbles can be induced to form on the first and second coatings, 21 and 22. These chlorine bubbles discourage the growth of marine organisms such as barnacles. As a result, the structure shown in FIG. 1 serves as an effective marine fouling preventative system.

The present invention has been described herein as being applied to boat hulls. However, it should be understood that the use of the conductive material, such as the graphite powder suspended in a vinyl ester matrix, can inhibit marine fouling in other submersible objects. Certain under water pipes and grates can also benefit from the application of the present invention. In addition, although boat hulls were described in detail herein, the present invention can be used to protect marine drive units, such as stern drive systems and outboard drives. The first coating can be applied to the submersible portion of the marine drive unit and an associated electrode can be attached at a preselected distance away from the drive unit. By connecting the electrode and the first coating to an electric current source, in the manner described above and as described in the patents cited above, chlorine bubbles can be induced to form on the first coating surface. This allows a marine drive to be protected from the growth of marine organisms, such as barnacles. It should be clearly understood that the electrode need not be a first coating made of the vinyl ester matrix and graphite powder. The present invention can therefore be applied to many devices in addition to boat hulls, such as marine propulsion devices, underwater pipes, pilings, and grates.

The material used in the present invention need not be vinyl ester in all embodiments. It can be any suitable polymer, such polyester, polyethylene or other polymer materials such as described in the Butler patents identified above. In addition, if the polymer is inherently conductive, a conductive filler is not required.

Although the present invention has been described in particular detail in conjunction with boat hulls, it should be understood that the present invention is applicable in many other ways and other embodiments are within its scope.

We claim:

1. Apparatus for inhibiting the fouling of a submersible object, comprising:

a first coating disposed on a first surface of an object which is submersible, said first coating comprising an electrically conductive polymer-based material;

an electrode; and an electrical current source which is connectable in electrical communication with said first coating and said electrode, said electrode being connectable in electrical communication with said electric current source to form an electrical circuit comprising said first coating, said electric current source, said electrode, and water in which both said electrode and said first coating are disposed, and further comprising:

a boat hull comprising a fiberglass layer, a conductive layer, and an intermediate layer, said conductive layer comprising said first coating.

2. Apparatus for inhibiting the fouling of a submersible object, comprising:

a first coating disposed on a first surface of an object which is submersible, said first coating comprising an electrically conductive polymer-based material;

an electrode; and an electrical current source which is connectable in electrical communication with said first coating and said electrode, said electrode being connectable in electrical communication with said electric current source to form an electrical circuit comprising said first coating, said electric current source, said electrode, and water in which both said electrode and said first coating are disposed, wherein:

said electrically conductive polymer-based material comprises a nonconductive polymer matrix with a first set of electrically conductive particles disposed therein;

said electrode comprises a second coating, said second coating comprising said nonconductive polymer matrix with a second set of electrically conductive particles disposed therein;

and further comprising:

a boat hull having a starboard side and a port side, said port side of said hull being at least partially covered by said first coating, said starboard side of said hull being at least partially covered by said second coating, said first and second coatings being electrically insulated from each other, wherein:

said boat hull has an inner fiberglass layer and an intermediate layer, said first coating being disposed on said port side of said intermediate layer, said second coating being disposed on said starboard side of said intermediate layer.

3. Apparatus for inhibiting the fouling of a submersible object, comprising:

a boat hull having a port side and a starboard side, said boat hull comprising a structural supporting layer;

a first coating layer disposed on said port side of said structural supporting layer, said first coating layer comprising a first material having a second material suspended within said first material, said second material being electrically conductive;

a second coating layer disposed on said starboard side of said structural supporting layer said second coating layer comprising said first material having said second material suspended within said first material, said first and second coating layers being electrically separated from each other;

a source of current connected in electrical communication with said first and second coating layers to sequentially cause an electrical current to flow in a direction from said source of current toward said first coating layer and subsequently to cause said electrical current to flow in a direction from said source of current toward said second coating layer;

and further comprising:

an intermediate layer disposed on said structural support layer, said first and second coating layers being disposed on said intermediate layer.

4. The apparatus of claim 3, wherein:

said intermediate layer is a gel coat compound.

5. The apparatus of claim 4, wherein:

said first and second coating layers comprise graphite particles supported in a vinyl ester matrix.

* * * * *